US006880949B2

(12) United States Patent
Miozza et al.

(10) Patent No.: US 6,880,949 B2
(45) Date of Patent: Apr. 19, 2005

(54) MULLION ASSEMBLY FOR REFRIGERATOR QUICK CHILL AND THAW PAN

(75) Inventors: Debra Miozza, Louisville, KY (US); Scott Wayne Lange, Louisville, KY (US); Ravi Kumar Yellajosula, St. Andhra Pradesh (IN); Asma Hamid Iqbal, Louisville, KY (US)

(73) Assignee: General Electric Company, Schenectady, NY (US)

( * ) Notice: Subject to any disclaimer, the term of this patent is extended or adjusted under 35 U.S.C. 154(b) by 234 days.

(21) Appl. No.: 09/683,077

(22) Filed: Nov. 15, 2001

(65) Prior Publication Data

US 2003/0090890 A1 May 15, 2003

(51) Int. Cl.[7] ..... O21V 33/00

(52) U.S. Cl. ..... 362/92; 362/94; 362/125; 362/133; 312/236; 312/116; 312/114; 312/223; 62/264; 62/44; 62/286

(58) Field of Search ..... 362/92, 94, 125, 362/126, 133; 312/401, 114, 236, 116, 223; 62/264, 1, 44, 286

(56) References Cited

U.S. PATENT DOCUMENTS

| | | | | |
|---|---|---|---|---|
| 3,659,429 A | | 5/1972 | McLean | |
| 3,747,361 A | | 7/1973 | Harbour | |
| 3,759,053 A | | 9/1973 | Swaneck, Jr. | |
| 3,918,269 A | | 11/1975 | Summers et al. | |
| 4,326,390 A | | 4/1982 | Brooks | |
| 4,358,932 A | | 11/1982 | Helfrich, Jr. | |
| 4,368,622 A | | 1/1983 | Brooks | |
| 4,385,075 A | | 5/1983 | Brooks | |
| 4,627,246 A | * | 12/1986 | Wilson | 62/286 |
| 4,732,009 A | | 3/1988 | Frohbieter | |
| 4,858,443 A | | 8/1989 | Denpou | |
| 4,876,860 A | | 10/1989 | Negishi | |
| 4,916,921 A | * | 4/1990 | Fletcher | 62/356 |
| 5,212,962 A | | 5/1993 | Kang et al. | |
| 5,701,235 A | * | 12/1997 | Hagemeyer Cook et al. | 362/26 |
| 5,758,512 A | | 6/1998 | Peterson et al. | |
| 6,325,523 B1 | * | 12/2001 | Santosuosso et al. | 362/125 |
| 6,478,445 B1 | * | 11/2002 | Lange et al. | 362/223 |
| 6,539,729 B1 | | 4/2003 | Tupis et al. | |
| 6,557,362 B1 | | 5/2003 | Wilson | |
| 6,564,561 B1 | | 5/2003 | Daum et al. | |
| 6,574,974 B1 | | 6/2003 | Herzog et al. | |
| 6,606,870 B1 | | 8/2003 | Holmes et al. | |
| 6,619,814 B1 | * | 9/2003 | Hamada et al. | 362/127 |
| 6,625,999 B1 | | 9/2003 | Hu et al. | |
| 6,631,620 B1 | | 10/2003 | Gray et al. | |
| 6,655,158 B1 | | 12/2003 | Wiseman et al. | |
| 6,655,169 B1 | | 12/2003 | Tupis et al. | |
| 6,668,568 B1 | | 12/2003 | Holmes et al. | |
| 6,675,603 B1 | | 1/2004 | Lesyna et al. | |

* cited by examiner

*Primary Examiner*—Sandra O'Shea
*Assistant Examiner*—Bertrand Zeade
(74) *Attorney, Agent, or Firm*—H. Neil Houser, Esq.; Armstrong Teasdale LLP

(57) ABSTRACT

A mullion assembly for a refrigerator quick chill pan is provided. The mullion assembly includes a base comprising a top surface and a bottom surface, a first light element coupled to said base for producing light above said top surface, and a second light element coupled to said base for producing light below said bottom surface.

22 Claims, 8 Drawing Sheets

MULLION ASSEMBLY FOR REFRIGERATOR QUICK CHILL AND THAW PAN

BACKGROUND OF INVENTION

This invention relates generally to refrigerators, and, more particularly, to refrigerators having a quick chill and thaw pan therein for rapid chilling and safe thawing of food and beverage items therein.

A typical household refrigerator includes a freezer storage compartment and a fresh food storage compartment either arranged side-by-side and separated by a center mullion wall or over-and-under and separated by a horizontal center mullion wall. Shelves and drawers typically are provided in the fresh food compartment, and shelves and wire baskets typically are provided in the freezer compartment. In addition, an ice maker may be provided in the freezer compartment. A freezer door and a fresh food door close the access openings to the freezer and fresh food compartments, respectively.

Numerous quick chill and super cool compartments located in refrigerator fresh food storage compartments and freezer compartments have been proposed to more rapidly chill and/or maintain food and beverage items at desired controlled temperatures for long term storage. See, for example, U.S. Pat. Nos. 3,747,361, 4,358,932, 4,368,622, and 4,732,009. These compartments, however, undesirably reduce refrigerator compartment space, are difficult to clean and service, tend to affect the temperature of the fresh food compartment in use, and have not proven capable of efficiently chilling foods and beverages in a desirable time frame. Attempts have also been made to provide thawing compartments located in a refrigerator fresh food storage compartment to thaw frozen foods. See, for example, U.S. Pat. No. 4,385,075. These thawing compartments, however, are vulnerable to spoilage of food due to excessive temperatures in the compartments.

Recent advances have allowed rapid chilling and safe thawing of items in a pan located in one of the refrigeration compartments. In one type of refrigerator, a modular air handler includes ductwork between the refrigeration and freezer compartments, air supply and return paths for airflow between one of the refrigeration compartments and the pan, damper assemblies for regulating airflow through the supply and return paths, a fan element for forcing air through the supply and return paths, and a heater element. By manipulating the fan element, damper assemblies, and the heater element, precise temperature regulation may be achieved to rapidly chill, safely thaw, of maintain the pan at a selected temperature independent of the temperature of the fresh food compartment and the freezer compartment.

While such quick chill and thaw systems are effective for rapid chilling, safe thawing, and long term storage at specified temperatures, issues such as convenient controls for selecting a mode of operation for operation, serviceability of the system, and adequate lighting and visibility of the pan for use, have yet to be satisfactorily resolved.

SUMMARY OF INVENTION

In one aspect, a mullion assembly for a refrigerator quick chill pan is provided. The mullion assembly comprises a base comprising a top surface and a bottom surface, a first light element coupled to said base for producing light above said top surface, and a second light element coupled to said base for producing light below said bottom surface.

In another aspect, a refrigerator pan assembly is provided. The assembly comprises a pan and an insulated mullion assembly overlying said pan. The mullion assembly comprises a top surface, at least one light source extending through said top surface for illuminating said pan from above, and a switch assembly mounted to said top surface for user selection of a pan condition.

In an additional aspect, a refrigerator is provided. The refrigerator comprises a liner comprising a refrigeration compartment and a mullion assembly mounted within said refrigeration compartment in a substantially horizontal position. The mullion assembly comprises a base, a first light source coupled to said base for producing light above said base and a second light source coupled to said base for producing light below said base.

In yet another aspect, a refrigerator quick chill and thaw system is provided. The system comprises a pan, a mullion base situated substantially horizontally above said pan a light coupled to said base for illuminating said pan, a control panel coupled to said base for user selection of a pan condition, and a control board coupled to said base and operatively coupled to said control panel.

In still another aspect, a quick chill and thaw system for a refrigerator including at least a quick chill and thaw fan, an air supply in communication with the fan, and a heater element in communication with the fan is provided. The system comprises a pan in fluid communication with the fan, the air supply, and the heater element, and a mullion base situated substantially horizontally above said pan. A light is coupled to said base for illuminating said pan, and a control panel is coupled to said base for user selection of a pan condition. A control board is coupled to said base and operatively coupled to said control panel, said control board regulating the fan, air supply, and heater element in accordance with a selected one of a plurality of modes of operation, said plurality of modes comprising at least a quick chill mode and a thaw mode.

In still another aspect, a refrigerator comprising at least one refrigeration compartment, a pan located within said at least one compartment and operable in a plurality of modes thermally independent of said refrigeration compartment, and an insulated mullion assembly overlying said pan and thermally isolating said pan from said fresh food compartment is provided.

DETAILED DESCRIPTION

Figure 1:
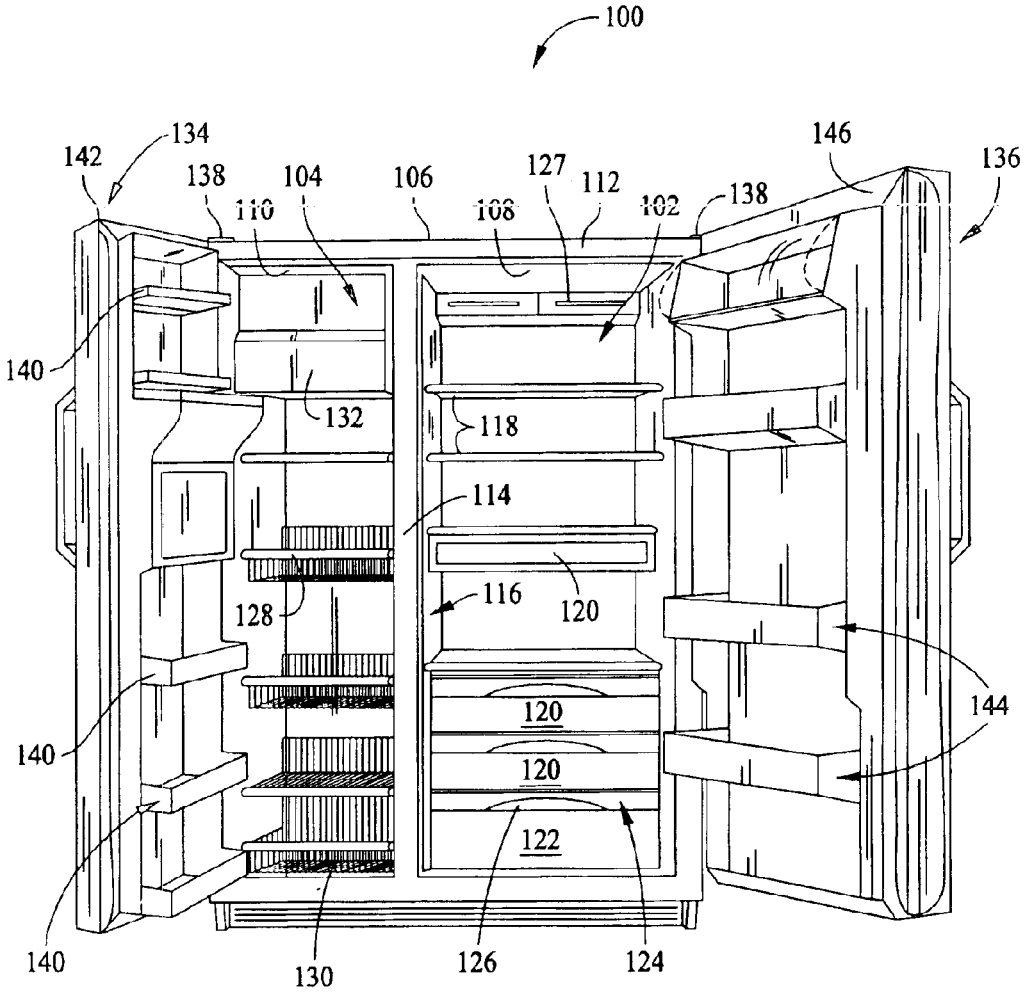
FIG. 1 is a perspective view of an exemplary refrigerator including a quick chill and thaw system.

FIG. 1 is a perspective view of an exemplary refrigerator 100 including a fresh food storage compartment 102 and freezer storage compartment 104. Freezer compartment 102 and fresh food compartment 104 are arranged side-by-side. While the present invention is described and illustrated with respect to a particular refrigerator 100, the embodiment set forth herein is intended for illustrative purposes only. It is recognized that refrigerator 100 is but one type of refrigerator in which the benefits of the present invention may be demonstrated, and consequently, any intention to restrict practice of the present invention to a particular type of refrigerator, such as refrigerator 100, is expressly disavowed.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system, described in detail below and selectively controlled, together with other refrigerator features, by a microprocessor (not shown in FIG. 1) coupled to a quick chill and thaw system mullion assembly 124 extending substantially horizontally across fresh food compartment above quick chill and thaw system pan 124. A control panel interface is 126 is mounted to quick chill mullion 124 for user selection of quick chill and thaw system features, described further below.

Pan 122 is sealed for independent temperature control from fresh food compartment 102 and fresh food compartment 104, and a fan element (not shown in FIG. 1), a heater element (not shown in FIG. 1) and ductwork (not shown) are located behind and in fluid communication quick chill and thaw system pan 122. The ductwork extends through center mullion wall 116 to place quick chill and thaw system pan 122 in communication with cold freezer compartment air, and the fan generates a circulating air stream within pan 122 for rapid chilling of items therein, such as cans of soda, for example. Access to freezer compartment air is adjustable with a damper assembly (not shown) for precise temperature regulation in pan 122, together with dampers (not shown) located in air supply and return paths located behind pan 122. The heater element is operable in conjunction with the fan to safely thaw items in pan 122 while avoiding spoilage, or to maintain temperatures in pan 122 at levels above a temperature of fresh food compartment 102. Temperature sensors (not shown) are employed for precise temperature regulation of pan 122 in a quick chill mode, a thaw mode, and a long term storage mode at temperatures above or below fresh food compartment temperature. Of course, the quick chill and thaw system may be inactivated such that pan 122 reaches a steady state temperature approximately equal to the temperature of fresh food compartment 102 where pan 122 is located.

Fresh food compartment and freezer compartment temperatures are set according to user preference via manipulation of a control interface 127 mounted in an upper region of fresh food storage compartment 102 and coupled to a microprocessor (not shown). Shelves 128 and wire baskets 130 are also provided in freezer compartment 104. In addition, an ice maker 132 may be provided in freezer compartment 104.

A freezer door 134 and a fresh food door 136 close access openings to fresh food and freezer compartments 102, 104, respectively. Each door 134, 136 is mounted by a top hinge 138 and a bottom hinge (not shown) to rotate about its outer vertical edge between an open position, as shown in FIG. 1, and a closed position (not shown) closing the associated storage compartment. Freezer door 134 includes a plurality of storage shelves 140 and a sealing gasket 142, and fresh food door 136 also includes a plurality of storage shelves 144 and a sealing gasket 146.

In accordance with known refrigerators, a machinery compartment (not shown) at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments.

Figure 2:
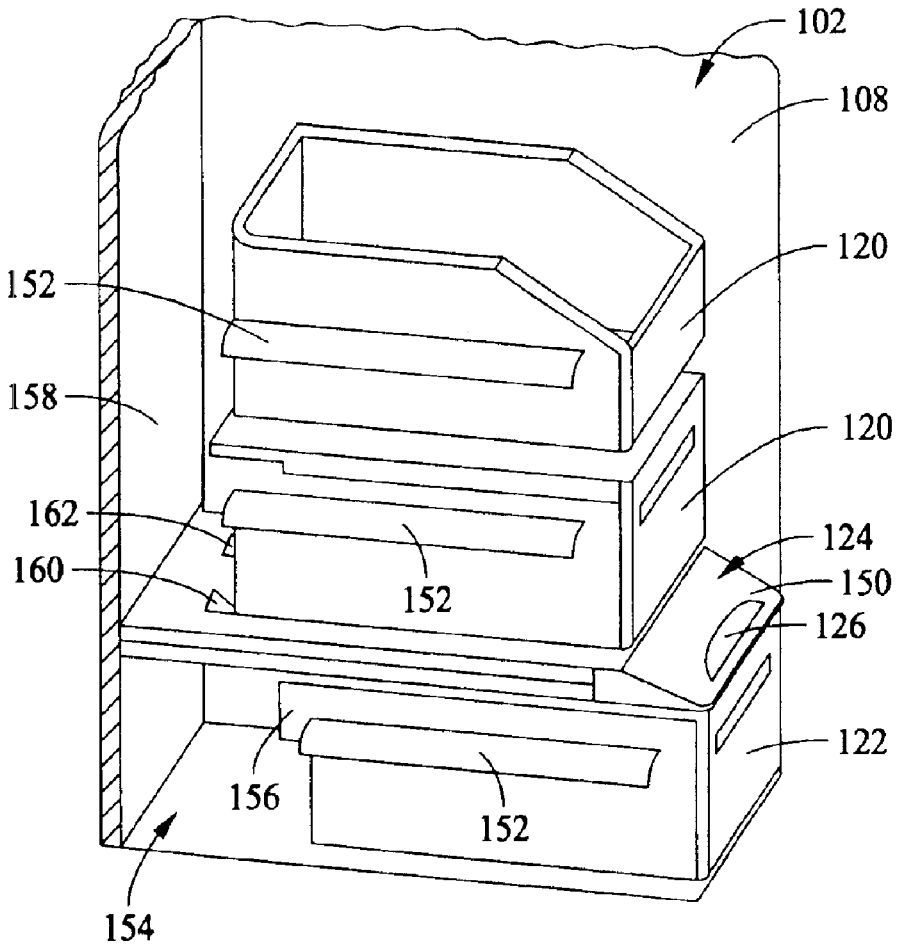
FIG. 2 is a cross sectional cutaway view of a portion of the refrigerator shown in FIG. 1 at the location of the quick chill and thaw system.

FIG. 2 is a cross sectional cutaway view of a lower portion fresh food compartment 102 wherein pans 120 and quick chill and thaw system pan 122 are located. Quick chill mullion 124 extends substantially horizontally across fresh food compartment 102 and overlies quick chill and thaw system pan 122, while pans 120 are situated above quick chill mullion 124. Quick chill mullion 124 extends fully from side to side and front to back of fresh food compartment 102, thereby forming a horizontal partition across fresh food compartment 102 above quick chill and thaw system pan 122. As explained in some detail below, quick chill mullion 124 includes insulation that facilitates substantially complete thermal isolation of quick chill and thaw system pan 122 located below mullion 124 from temperature conditions in fresh food compartment 102 above quick chill mullion 124. Thus, quick chill and thaw pan 122 may be operated at selected temperature conditions independent of fresh food compartment 102, without substantially affecting or being affected by fresh food compartment temperature.

Quick chill and thaw system control panel interface 126 is mounted on a forward sloped portion 150 of quick chill mullion 124 for convenient user access within a clear line of sight when fresh food compartment access door 136 is opened. In an exemplary embodiment, storage pans 120 and quick chill and thaw system pan 122 each include rails 152 on lateral sides thereof for slide-out insertion into plastic side supports (not shown) attached to each side wall of metal fresh food compartment liner 108. In an alternative embodiment, pan rails 152 are inserted into molded channels (not shown) formed into the sides of a plastic fresh food compartment liner.

A quick chill and thaw system machinery compartment 154 extends beneath quick chill mullion 124 and behind quick chill and thaw pan 122. Machinery compartment 154 houses the above described fan element, heater element and damper assemblies for operation of the quick chill and thaw system. Machinery compartment 154 is in flow communication with freezer compartment 104 (shown in FIG. 1) through ductwork extending through center mullion wall 116 (shown in FIG. 1) extending between freezer compartment 102 and fresh food compartment 104. In an illustrative embodiment, the ductwork includes a supply duct and a return duct, separately controlled by damper assemblies, and an air handler unit (not shown in FIG. 2) defines supply and return paths in flow communication with the supply and return ducts. The fan element and the heater element are located within the air handler unit behind quick chill and thaw system pan 122, and the air handler is in flow communication with the pan through openings (not shown) in an upper rear wall 156 of pan 122. In one embodiment, the air handler is a modular unit that may be installed and removed from machinery compartment 154 as a unit, although in alternative embodiments it is appreciated that air handler components need not be integrated in a single removable package to achieve the benefits of the instant invention.

Storage pans 120 are distanced from a rear wall 158 of fresh food compartment 104, and light assemblies 160, 162 are coupled to quick chill mullion 124 and produce light angled upwardly at an angle to illuminate pans 120, which in an exemplary embodiment each pan 120 includes translucent sides so that contents of pans 120 are evident even when pans 120 are in a closed position. Likewise, quick chill and thaw system pan 122, in an exemplary embodiment, includes translucent sides, and a light assembly (not shown in FIG. 2) is coupled to quick chill mullion 124 to illuminate quick chill and thaw system pan 122 from above. It is contemplated, however that pans 120, 122 need not be fabricated from translucent materials in alternative embodiments and that the light assemblies 160, 162 coupled to quick chill mullion 124 may be employed for indirect illumination of pans 120, 122 in an opened position.

Additionally, in an exemplary embodiment the light assemblies coupled to quick chill mullion 124 are activated by a door switch (not shown) and associated controls to energize the light assemblies whenever fresh food compartment access door 136 (shown in FIG. 2) is opened. It is contemplated, however, that in alternative embodiments the light assemblies may be selectively activated by a user, such as with switches on control panel interface 126 or with switches and/or sensors coupled to pans 120, 122 to selectively illuminate one of the pans.

Figure 3:
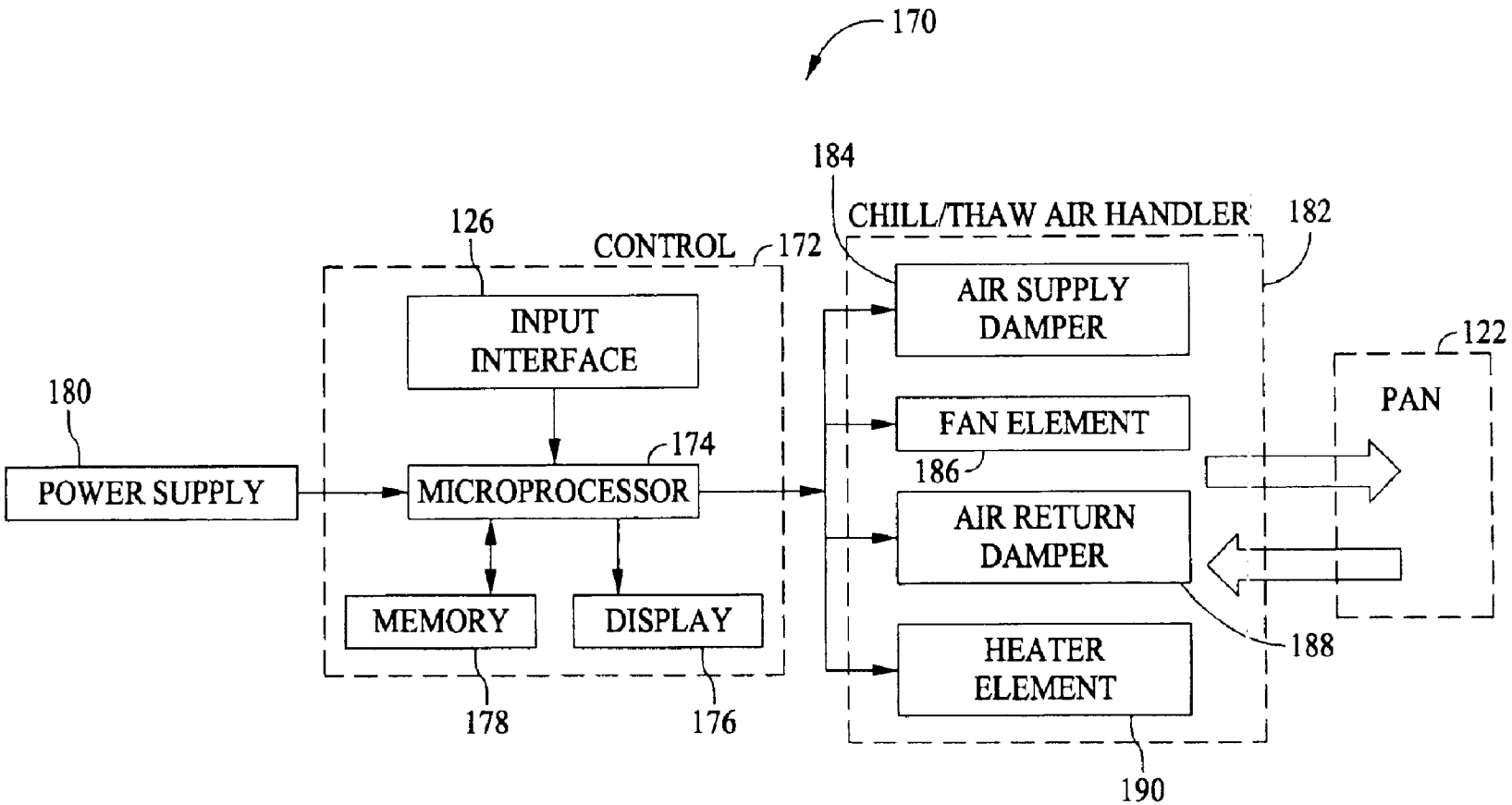
FIG. 3 is a schematic block diagram of the quick chill and thaw system shown in FIGS. 1 and 2.

FIG. 3 is a schematic block diagram of a quick chill and thaw system 170 for use with, for example, refrigerator 100 (shown in FIG. 1).

Quick chill and thaw system 170 includes a controller 172 which may, for example, be a microcomputer 174 coupled to a input interface, such quick chill and thaw system control panel 126 coupled to quick chill mullion 124 (shown in FIGS. 1 and 2). An operator may enter instructions or select desired quick chill and thaw cycles and features via user interface input 126, and a display 176 coupled to microcomputer 174 displays appropriate cycle times, temperature settings, indicators, and other known items of interest to system users. A memory 178 is also coupled to microcomputer 174 and stores instructions, calibration constants, and other information as required to satisfactorily execute a selected quick chill and thaw system mode. Memory 178 may, for example, be a random access memory (RAM). In alternative embodiments, other forms of memory could be used in conjunction with RAM memory, including but not limited to electronically erasable programmable read only memory (EEPROM).

In an exemplary embodiment, control panel 126 includes an integrated display 176, but it is appreciated in alternative embodiments that display 176 could be located remotely from control panel 126. Further, in an illustrative embodiment, microprocessor 174 and memory 178 are coupled to a control board (not shown in FIG. 3) that is coupled to quick chill mullion 124, although in an alternative embodiment microprocessor could be a remotely located processor used to control the larger refrigeration system in refrigerator 100.

Power to system 170 is supplied to controller 172 by a power supply 180 configured to be coupled to a power line. Analog to digital and digital to analog convertors (not shown) are coupled to controller 172 to implement controller inputs and executable instructions according to known methods to generate controller output to a modular air handler 182 for regulating temperature and airflow within quick chill and thaw system pan 122. Air handler 182 includes an air supply damper 184, a fan element 186, an air return damper 188, and a heater element 190. In response to manipulation of user interface input 126, controller 172 monitors various operational factors of air handler 182, and executes operator selected functions and features to produce desired temperature and air stream conditions within pan 122 for the selected mode of operation. Controller 172 operates the various components of air handler 182 according to known methods and techniques.

In a further embodiment, one or more transducers (not shown) are employed in conjunction with air handler 182 and/or pan 122 to precisely monitor and regulate conditions in pan 122. For example, one or more thermistors may be employed to sense pan temperature and produce a feedback signal to controller 172 for adjustment of dampers 184, 188, fan element 186, and heater element 190 according to sensed pan conditions. Additionally, transducers may be used to monitor fan speed, damper positions, etc. and signals fed back to controller 172 for feedback control according to known methods. Memory 166, in one embodiment, includes a variety of calibration constants and control parameters for the various components of air handler 182, as well as cycle and function instructions and data corresponding to a particular mode of operation selected via user manipulation of control panel 126.

Figure 4:
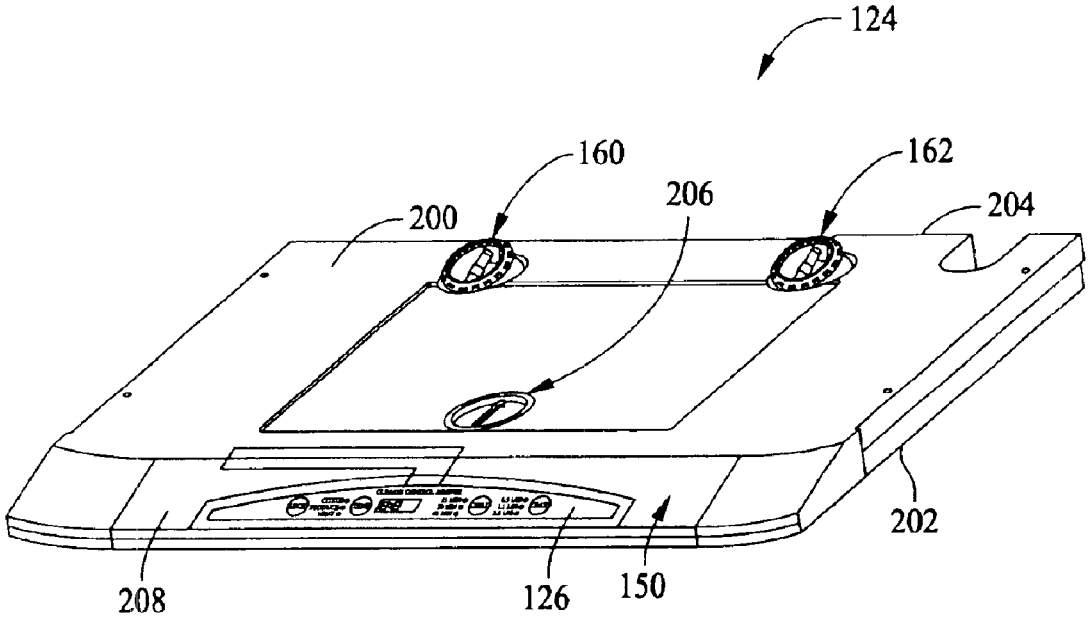
FIG. 4 is a top perspective view of an exemplary quick chill and thaw system mullion assembly.

FIG. 4 is a top perspective view of an exemplary quick chill and thaw system mullion 124 including a top surface 200, a bottom surface 202 and inclined forward portion 150 extending from a forward end of top surface 200. Light assemblies 160, 162 are coupled to mullion top surface 200 at a distance from a rear edge 204 of mullion 124 and are oriented at an angle thereto for directing light above mullion top surface 200 and into storage pans 120 (shown in FIGS. 1 and 2) from behind, and a light assembly 206 is located in a mid-section of mullion 124 and directs light downwardly below mullion bottom surface 122 and into quick chill and thaw system pan 122 (shown in FIGS. 1–3). Control panel 126 is mounted to an outer surface 208 of mullion forward portion 150 and is operatively coupled to microprocessor 174 (shown in FIG. 3) for operating air handler 182 (shown in FIG. 3) in response to user manipulation of control panel 126.

Figure 5:
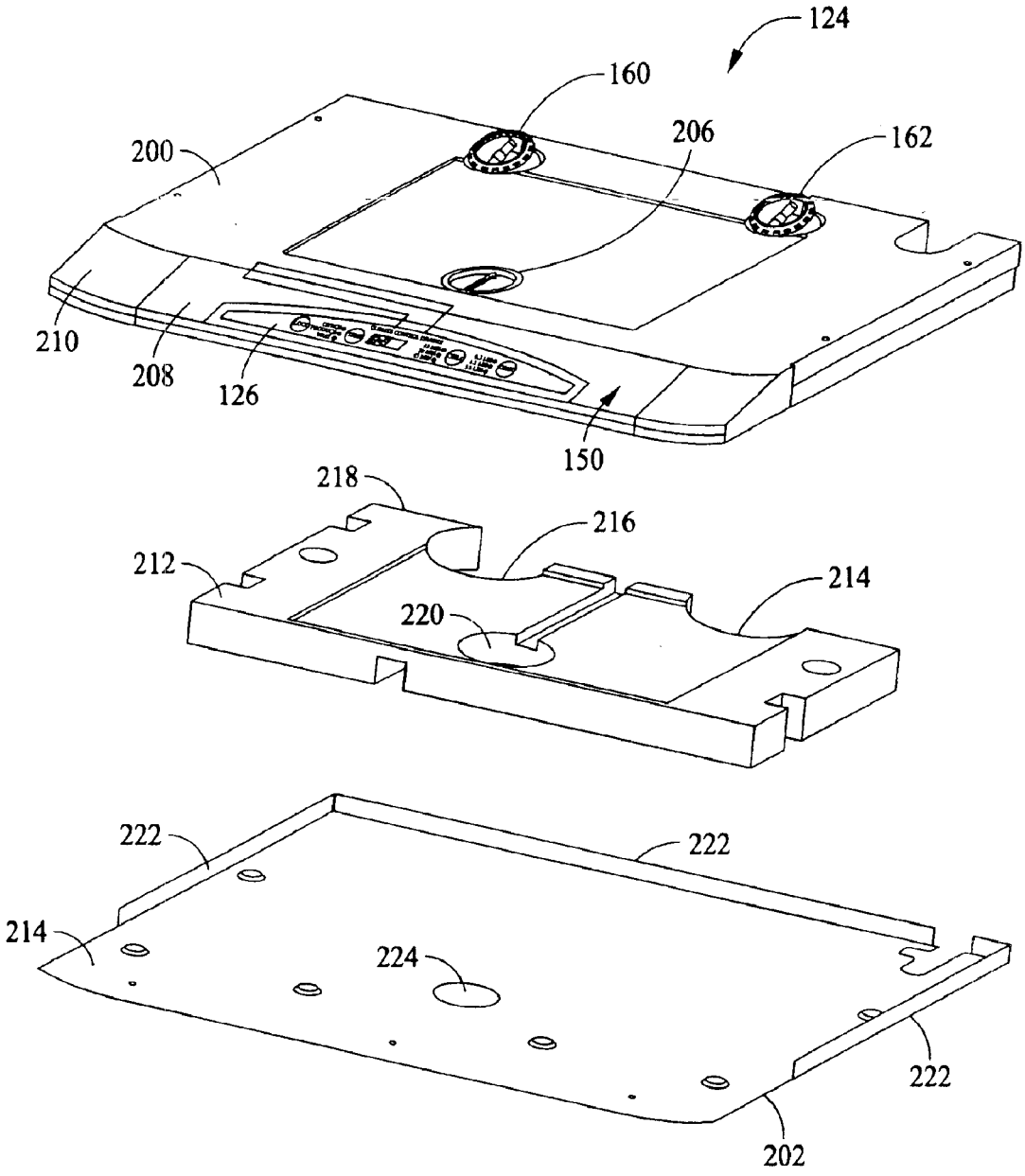
FIG. 5 is an exploded perspective view of the mullion assembly shown in FIG. 4.

FIG. 5 is an exploded perspective view of quick chill mullion 124 including a base portion 210, an insulating layer 212 and a bottom cover plate 214. Base portion 124 is fabricated from a known plastic material in one embodiment, and includes light assemblies 160, 162 and 206, and control panel 126 mounted thereto. Insulating layer 212 is fabricated from a known thermal insulating medium or material, such as expanded polystyrene (EPS) in an exemplary embodiment, and serves to insulate and substantially isolate quick chill and thaw system pan 122 (shown in FIGS. 1–3) from thermal conditions of fresh food compartment 102 (shown in FIGS. 1 and 2) when pan 122 is in the closed position. In an illustrative embodiment, insulating layer 212 includes a first light recess 216 extending along a rear edge 218 of insulating layer 212 for accommodating light assembly 160 at a first angle relative to base portion top surface 200, a second light recess 219 extending along rear edge 218 for accommodating light assembly 162 at a second angle relative to base portion top surface 200, and a third light opening 220 for accommodating base portion light assembly 206.

Bottom cover plate 214 is substantially rectangular in one embodiment and includes upstanding side rails 222 extending from respective side edges of cover plate 214 around insulating layer 212 and extend rearward from base forward portion 150 when mullion 124 is assembled. Cover plate 214 includes a light opening 224 for receiving light assembly 206 such that light assembly 206 produces light beneath a lower surface 202 of cover plate 214 when energized, thereby illuminating quick chill and thaw system pan 122. In one embodiment, cover plate 214 is fabricated from metal, although in alternative embodiments it is recognized that other known materials suitable for the refrigeration environment may be employed.

Base portion 210 and cover plate 214 are fastened to one another with known attachment members, such as screws (not shown) in an illustrative embodiment, with insulating layer sandwiched between base portion 210 and cover plate 214. Apertures are formed into insulating layer 212 for routing of wires for lighting assemblies 160, 162, 206 and electronic controls (not shown in FIG. 5) coupled to control interface 126 beneath base forward portion outer surface 208. In a further embodiment, a wiring harness (not shown) is employed to facilitate wiring of the electrical components of quick chill mullion 124.

Figure 6:
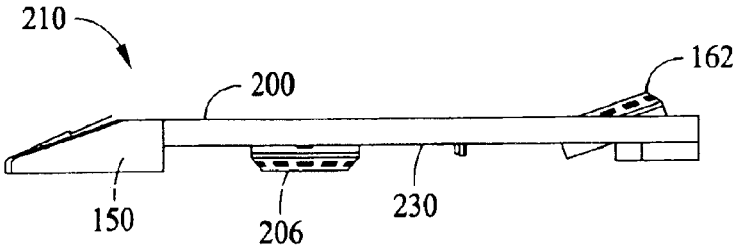
FIG. 6 is a side elevational view of a portion of the mullion assembly shown in FIGS. 4 and 5.

FIG. 6 is a side elevational view of an assembled mullion base portion including angled light assembly 162 extending from base top surface or side 200, and light assembly 206 extending through base portion 210 and beneath a bottom surface or side 230. As such, light assemblies 162, 206 are configured to illuminate areas both above and below mullion base portion 210. Base forward portion 150 is generally triangular in profile and is thicker than a remainder of base portion 210.

Figure 7:
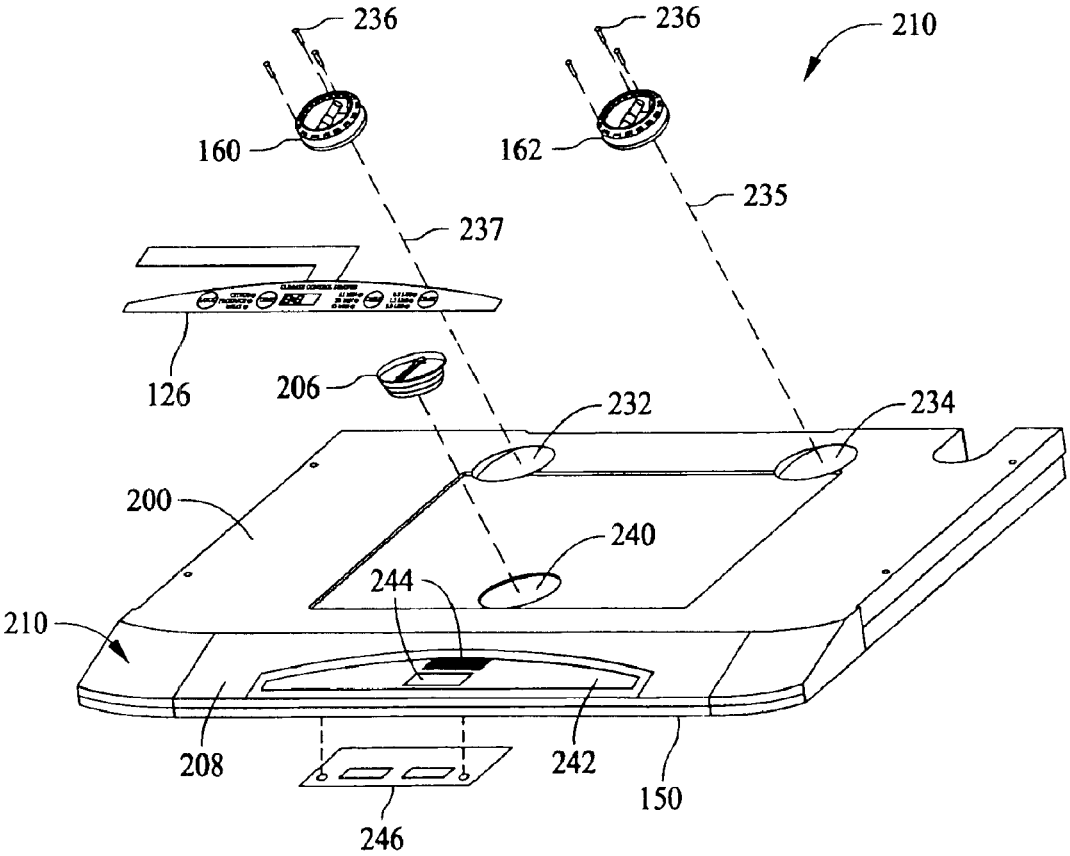
FIG. 7 is a partial perspective assembly view of the portion of the mullion assembly shown in FIG. 6.

FIG. 7 is a partial perspective assembly view mullion base portion 210. Light assemblies 160, 162 each include a lamp base, a light holder assembly, and halogen bulb in an exemplary embodiment. Each light assembly 160, 162 is secured together with known fasteners, and is secured to recessed light platforms 234 formed into base portion top surface 200 with known fasteners, such as screws 236 so as to be directed along different respective axes 235, 237 with respect to one another and also with respect to base portion top surface 200. Light assembly includes a lamp holder, described in detail below, that is removably coupled to base portion via an aperture 240 extending through base portion top surface 200.

In an exemplary embodiment, control panel 126 is a known pressure sensitive membrane switch assembly that is mounted upon a recessed control panel area 242 in a top surface 208 of mullion base forward portion 150 according to known techniques. Apertures 244 extend through top surface 200 of base forward portion 150 for electrical connections to a control board 246 that is coupled to base portion 210 underneath control panel area 242. Control board 246, in one embodiment, includes microprocessor 174 (shown in FIG. 3), memory 178 (shown in FIG. 3) as well as associated circuitry to execute control functions of quick chill and thaw system 170 (shown in FIG. 1) in response to user manipulation of control panel 126. Control board 246 is coupled to air handler 182 to operate quick chill and thaw system 170 is a selected mode of operation and to generate desired temperature conditions within quick chill and thaw system pan 122. Control board 246 is coupled to base portion 246, retained in one embodiment to base forward portion 150 with snap-fit engagement, and secured to base portion 210 with known fasteners, such as screws.

Figure 8:
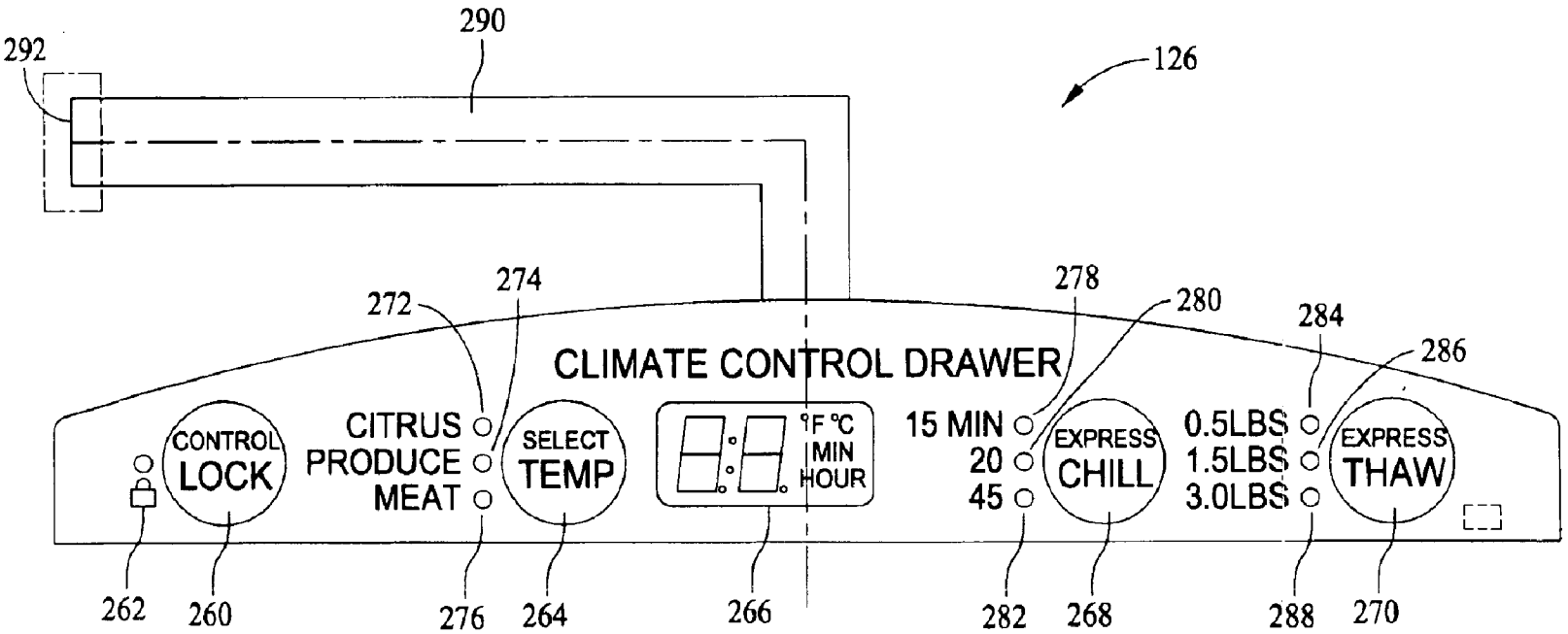
FIG. 8 is a top plan view of a control panel interface for the mullion assembly shown FIG. 4.

FIG. 8 is a top plan view of control panel interface 126 for quick chill mullion base portion 210 and illustrating exemplary modes of operation of quick chill and thaw system 170 (shown in FIG. 3) executable by control board 246 (shown in FIG. 7). Control panel 126 includes a LOCK selector 260 and lock indicators 262, a SELECT TEMP selector 264, a center display 266, a CHILL function selector 268, and a THAW function selector 270.

In an exemplary embodiment, SELECT TEMP selector 264 includes at least a CITRUS option, a PRODUCE option, and MEAT option wherein air handler 182 (shown in FIG. 3) is operated at predetermined optimum temperatures for long term storage of the respective items in quick chill and thaw system pan 122. In an exemplary embodiment, depressing SELECT TEMP selector 264 once activates the CITRUS option and a corresponding CITRUS indicator 272 is lit. Depressing SELECT TEMP selector 264 again activates the PRODUCE option and a PRODUCE indicator 274 is lit. Depressing SELECT TEMP selector 264 again activates MEAT option and a MEAT indicator 276 is lit. Depressing SELECT TEMP selector 264 once more deactivates the SELECT TEMP function.

Additionally, in an exemplary embodiment, CHILL selector 268 includes at least three options including a 15 MINUTE option, a 30 MINUTE option, and a 45 MINUTE OPTION wherein air handler 182 is operated for rapid chilling of items in a designated time frame. In an exemplary embodiment, depressing CHILL selector 268 once activates the 15 MINUTE option and a corresponding 15 MINUTE indicator 278 is lit. Depressing CHILL selector 268 again activates the 30 MINUTE option and a 30 MINUTE indicator 280 is lit. Depressing CHILL selector 268 again activates 45 MINUTE option and a 45 MINUTE indicator 282 is lit. Depressing CHILL selector 268 once more deactivates the CHILL function.

Additionally, in an exemplary embodiment, THAW selector 270 includes at least three options including a 0.5 LB option, a 1.0 LB option, and a 1.5 LB OPTION wherein air handler 182 is operated for safe thawing of an item of a certain package size, such as meat measured in pounds. In an exemplary embodiment, depressing THAW selector 270 once activates the 0.5 LB option and a corresponding 0.5 LB indicator 284 is lit. Depressing THAW selector 270 again activates the 1.0 LB option and a 1.0 LB indicator 286 is lit. Depressing THAW selector 270 again activates 1.5 LB option and a 1.5 LB indicator 288 is lit. Depressing THAW selector 270 once more deactivates the THAW function.

In one embodiment, each of the above-described indicators is a light emitting diode (LED). In alternative embodiments, other known indicators may be employed in lieu of LEDs.

Center display 266 includes an alphanumeric LED display for indicating the selected temperature corresponding to each mode of system 170 and also functions as a countdown timer for the CHILL function. Of course, other functions and operating modes could be provided in alternative embodiments with appropriate modification of control panel 126 without departing from the scope of the present invention.

A flexible ribbon connector 290 extends from control panel 126 and includes a plurality of pins (not shown in FIG. 8) on an end 292 thereof. Connector end 292 may be coupled to control board 246 (shown in FIG. 7) with known connectors to establish an operative connection between control panel 126 and microprocessor 174 (shown in FIG. 3) located on control board 146.

Figure 9:
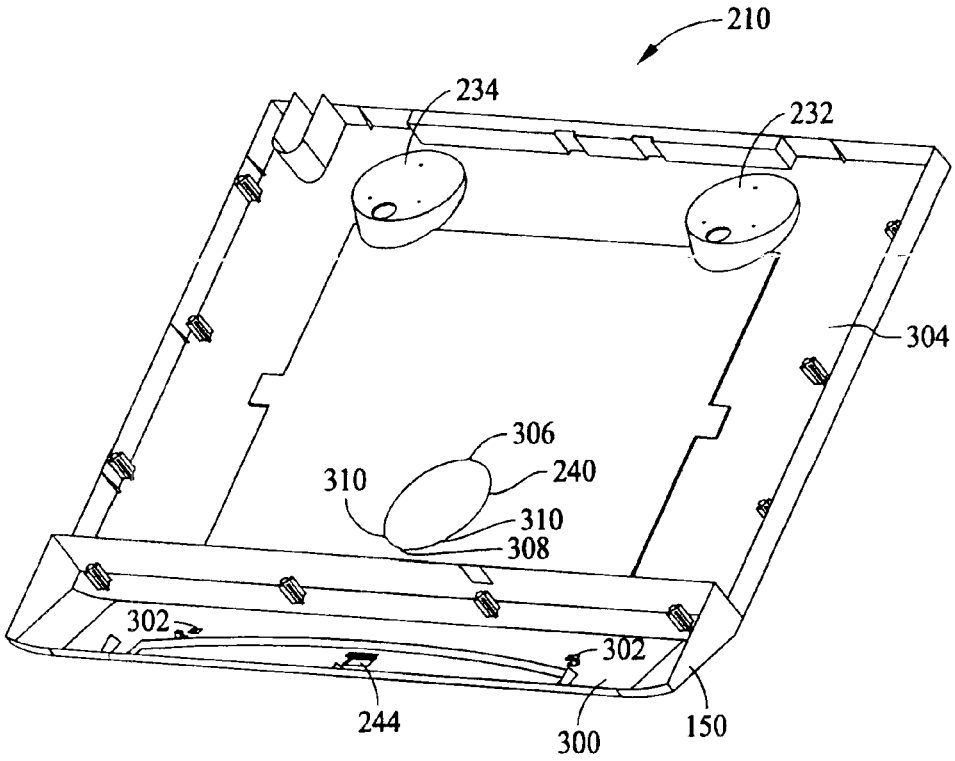
FIG. 9 is a bottom perspective view of the portion of the mullion assembly shown in FIGS. 6 and 7.

FIG. 9 is a bottom perspective view of quick chill mullion base portion 210 illustrating the underside thereof. Base forward portion 210 is hollow and adapted for receiving control panel 126 (shown in FIGS. 7 and 8) wiring connections through aperture 244 such that control panel 126 may be coupled to control board 246 (shown in FIG. 7) that is attached to an inner surface 300 of base forward portion 150 with screws 302. Light platforms 232, 234 extend from a bottom surface 304 of base portion 210 such that light assemblies 160, 162 (see FIG. 7) are oriented at appropriate angles therein so that light assemblies 160, 162 each illuminates one of storage pans 220 (shown in FIGS. 1 and 2).

Light opening 240 includes diametrically opposed slots, 306, 308 that receive a lamp holder (not shown in FIG. 10 but described below) for coupling light assembly 206 (shown in FIG. 7) to mullion base portion 210. Latch members 310 extend radially from slots 306, 308 to engage the lamp holder. Each latch member 310 is upwardly ramped from base bottom surface 304 such that projections on the lamp holder engage the ramps and maintain the lamp holder to the ramp with press fit engagement.

Figure 10:
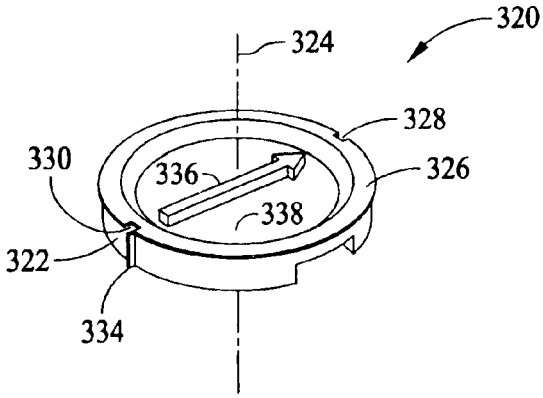
FIG. 10 is a top perspective view of a lamp holder for the mullion assembly shown in FIGS. 4 through 7.

FIG. 10 is a top perspective view of a lamp holder 320 that engages light opening 240 (shown in FIG. 9) and secures light assembly 206 to mullion base portion 210. Lamp holder 320 includes a cylindrical body portion 322 extending about a longitudinal axis 324 and a radially extending rim 326 extending from body 322. Slots 328, 330 are cut into rim 326, and projections 334 extend from an outer surface of cylindrical body 322 in substantial alignment with each of rim slots 328, 330. A small gap or clearance between an upper end of projections 334 and a lower surface of rim 326 facilitates hand insertion of lamp holder 300 to mullion base portion 210.

More specifically, projections 334 are inserted into slots 306, 308 (shown in FIG. 9) of base portion 210 (shown in FIG. 9) until lamp holder rim 326 contacts mullion base top surface 200 (shown in FIG. 7). Lamp holder is then rotated about axis 324 from above base portion top surface 200 until lamp holder projections 334 engage latch members 310 of mullion base portion 210 located adjacent light opening 240 (shown in FIG. 9) beneath mullion top surface 200. As lamp holder 320 is continued to be rotated about axis 320 with lamp holder projections 334 engaged to mullion base portion latch members 310, lamp holder rim 326 is drawn toward mullion base portion 210, eventually reaching a locked position when lamp holder projections 334 are fully engaged to latch members 310.

A raised arrow 336 extends upwardly from a top surface 338 of lamp holder both to differentiate between locked and unlocked positions of lamp holder 320 and to assist in gripping lamp holder 320 for rotation about axis 324 between the locked position wherein lamp holder projections are fully engaged to base portion latch members 310, and an unlocked position wherein lamp holder projections are aligned with base portion light opening slots 306, 308. For example, by rotating lamp holder 320 from the locked position until arrow 336 points to light opening slots 306, thereby revealing lamp holder projections 334 and indicating the unlocked position of lamp holder 320, lamp holder 320 and the attached light assembly 206 may be lifted from mullion base portion 258 for easy replacement without tools.

A relatively easily constructed, self contained quick chill and thaw system control unit is therefore provided in the form of a horizontal mullion for a quick chill and thaw system. Adequate storage pan lighting is provided both above and below the mullion, and the system is operable with a conveniently accessible and a and user friendly control panel coupled to the mullion. Serviceability and maintenance are facilitated with accessible and easily removable lighting fixtures mounted on the mullion, thereby increasing user satisfaction and enjoyment of the system.

While the invention has been described in terms of various specific embodiments, those skilled in the art will recognize that the invention can be practiced with modification within the spirit and scope of the claims.

What is claimed is:

1. An assembly comprising:

a refrigerator quick chill pan mullion assembly including:

a base comprising a top surface and a bottom surface;

a first light element coupled to said base for producing light above said top surface; and a second light element coupled to said base for producing light below said bottom surface.

2. An assembly in accordance with claim 1 wherein said first light element is oriented at an oblique angle with respect to said top surface.

3. An assembly in accordance with claim 1 further comprising a light element holder for coupling said second light element to said base, said light holder comprising an outer surface and a projection extending therefrom, said projection lockably engaging said holder to said base.

4. An assembly in accordance with claim 3, said base bottom surface comprising a latch projection extending therefrom, said lock projection engaging said light holder projection to lock said holder to said base.

5. An assembly in accordance with claim 1 further comprising a control panel switch assembly coupled to said base top surface, and a control board coupled to said base bottom surface.

6. A refrigerator pan assembly comprising:

a pan having a top; and an insulated mullion assembly extending generally over the top of said pan, said mullion assembly including a top surface, a first light source configured to illuminate said top surface of said mullion assembly, a second light source configured to illuminate said pan from above, and a switch assembly mounted to said top surface for user selection of a pan condition.

7. A refrigerator pan assembly in accordance with claim 6 further comprising a light holder for coupling said first and second light sources to said top surface, said light holder selectively positionable between a locked position and an unlocked position.

8. A pan assembly in accordance with claim 7 wherein said light holder comprises a cylindrical outer surface and a projection projecting therefrom.

9. A pan assembly in accordance with claim 8 wherein said mullion assembly comprises a bottom surface extending opposite said top surface, and an opening extending through said top surface and said bottom surface for receiving said first and second light sources, said opening having an outer perimeter and slot for receiving said projection.

10. A pan assembly in accordance with claim 9 wherein said mullion bottom surface comprises a retaining latch member for engaging said projection.

11. A pan assembly in accordance with claim 6 wherein said mullion assembly further comprises a base comprising a bottom surface extending opposite said top surface, and a control board mounted to said bottom surface in communication with said switch assembly.

12. A refrigerator comprising:

a liner including a refrigeration compartment; and a mullion assembly mounted within said refrigeration compartment in a substantially horizontal position, said mullion assembly having a base, a first light source coupled to said base for producing light above said base and a second light source coupled to said base for producing light below said base.

13. A refrigerator in accordance with claim 12, said base comprising a substantially flat top surface, said second light oriented at an oblique angle with respect to said top surface.

14. A refrigerator in accordance with claim 12, said base comprising a substantially flat top surface and a control panel thereon.

15. A refrigerator in accordance with claim 14, said control panel comprising a membrane switch assembly.

16. A refrigerator in accordance with claim 14, said base comprising a bottom surface extending opposite said top surface, and a control board coupled to said bottom surface and in communication with said control panel.

17. A refrigerator in accordance with claim 12 further comprising a light holder coupling said second light source to said base, said light holder rotatable between a locked position and release position.

18. A refrigerator in accordance with claim 17, said light holder comprising a cylindrical body and a rim extending radially therefrom, said cylindrical body comprising a projection extending therefrom in a spaced relationship to said rim.

19. A refrigerator quick chill and thaw system for a refrigerator including a fresh food compartment, said refrigerator quick chill and thaw system comprising:

a pan having a top;

a mullion for separating said pan from fresh food compartment, said mullion situated substantially horizontally above the top of said pan;

a light coupled to said mullion for illuminating said pan;

a control panel coupled to said mullion for user selection of a pan condition; and a control board coupled to said mullion and operatively coupled to said control panel.

20. A refrigerator quick chill and thaw system in accordance with claim 19, said mullion comprising a base portion, a bottom cover, and an insulating medium therebetween.

21. A quick chill and thaw system for a refrigerator including at least a compartment, quick chill and thaw fan, an air supply in communication with the fan, and a heater element in communication with the fan, said system comprising:

a pan in fluid communication with the fan, the air supply, and the heater element;

a mullion base for thermally isolating said pan from said compartment, said mullion base situated substantially horizontally above said pan;

a light coupled to said base for illuminating said pan;

a control panel coupled to said base for user selection of a pan condition; and a control board coupled to said base and operatively coupled to said control panel, said control board regulating the fan, air supply, and heater element in accordance with a selected one of a plurality of modes of operation, said plurality of modes comprising at least a quick chill mode and a thaw mode.

22. A refrigerator comprising:

a fresh food compartment;

a pan located within said fresh food compartment and operable in a plurality of modes thermally independent of said fresh food compartment; and an insulated mullion assembly overlying said pan and thermally isolating said pan from said fresh food compartment.

* * * * *